US006220264B1

(12) United States Patent
Newman

(10) Patent No.: US 6,220,264 B1
(45) Date of Patent: Apr. 24, 2001

(54) SUSPENSION TENT

(75) Inventor: Duncan Newman, Toronto (CA)

(73) Assignee: Terrelogic, Inc., Toronto (CA)

( * ) Notice: Subject to any disclaimer, the term of this patent is extended or adjusted under 35 U.S.C. 154(b) by 0 days.

(21) Appl. No.: 09/037,622

(22) Filed: Mar. 10, 1998

(30) Foreign Application Priority Data

Mar. 10, 1997 (CA) ..... 2199559

(51) Int. Cl.[7] ..... E04H 15/04; A45F 3/22

(52) U.S. Cl. ..... 135/90; 135/95; 135/137; 135/115; 5/121; 5/113

(58) Field of Search ..... 135/90, 95, 96, 135/115, 116, 148, 137, 138, 900, 902, 904, 125; 5/120–121, 111–114; 482/27–29; 224/153–156

(56) References Cited

U.S. PATENT DOCUMENTS 650,554 * 5/1900 Conley ..... 5/121 X
1,209,479 * 12/1916 Nesom ..... 5/121 X
2,442,132 * 5/1948 Laythe ..... 135/95
2,567,697 * 9/1951 Craighead, Jr. et al. ..... 135/95 X
2,788,530 * 4/1957 Ferguson ..... 5/122 X
3,215,153 * 11/1965 Huddle ..... 135/905 X
3,545,461 * 12/1970 Carlson ..... 135/95 X
4,320,542 * 3/1982 Cohen ..... 5/121
4,526,307 * 7/1985 Parler ..... 135/95 X
4,811,751 * 3/1989 Maloney, II ..... 135/96 X

* cited by examiner

*Primary Examiner*—Carl D. Friedman
*Assistant Examiner*—Winnie Yip
(74) *Attorney, Agent, or Firm*—Dowell & Dowell, P.C.

(57) ABSTRACT

This invention provides in an article of manufacture having a fabric support surface: a fabric support surface; a peripheral frame for the support surface, said frame having opposed base sections and opposed flexible arch sections extending between the base sections; and arch flexing means for moving the opposed base sections towards each other to flex the arch sections outwardly of each other and for maintaining the base sections from separation whereby to tension the fabric support surface between the arch sections and form a firm support for weight placed thereon and to restrain the effect of weight thereon from moving the opposed arch sections inwardly of each other.

8 Claims, 4 Drawing Sheets

SUSPENSION TENT

This invention relates to a light weight tent that can be suspended form overhead to support the floor above the ground.

BACKGROUND OF THE INVENTION

There is a substantial need for tents of this class. They would have application in difficult frontier travel where the usual means of transport is back pack. The importance of lightness of weight will be apparent. The presently available tents in this class have a fabric bottom supported by a rectangular steel peripheral frame strong enough to support the floor. They are heavy and cumbersome, but, notwithstanding this objection, remain in use because there is no alternative. Typically, these tents weight over 30 pounds mostly because of the weight of the frame.

In respect of the tents of the prior art, which have a fabric support surface with a tubular metal peripheral frame, when load is applied to the floor the downward force of the weight tends to draw in the opposed sides of the frame. This results in a sag in the floor. To avoid undue sag from this cause, it has been the practice to design the frame to be strong enough to resist it. The result has been heavy frames that significantly contribute to the overall weight of the tent for transport.

SUMMARY OF THE INVENTION

This invention overcomes the problem of having to use heavy frames to avoid sag and it does so by a unique arched configuration for the sides of the frame that support the floor. The floor is supported between two opposed flexible arches that extend between two opposed base sections of the frame. The base sections are drawn towards each other to flex the arched sections outwardly of each other to stretch the fabric of the floor between them and provide a firm flat surface able to support the weight to be placed on it in use.

The base sections are so drawn together by means of a belt and they are maintained in this position by keeping the tension on the belt. Thus, the ends of the arches are located against outward movement. This prevents any inward movement of the sides toward each other as a result of downward forces on the floor during use. The downward forces of weight on the floor appear as increased tension on the belt that extends longitudinally of the base section of the frame.

The arched frame design makes it possible to make a support surface of much reduced weight and therefore a tent of much reduced weight while giving a support surface design that does not sag as a result of frame flexing due to weight on the floor.

It is therefore an object of this invention to provide an improved light weight suspension tent of good utility and low cost that has an improved floor construction.

It is a further object of the invention to provide an improved floor construction in any article of manufacture that has a metal frame for a fabric or like support surface.

With these and other objects in view, according to this invention there is provided in an article of manufacture having a fabric support surface: a fabric support surface; a peripheral frame for the support surface, said frame having opposed base sections and opposed flexible arch sections extending between the base sections; and arch flexing means for moving the opposed base sections towards each other to flex the arch sections outwardly of each other and for maintaining the base sections from separation whereby to tension the fabric support surface between the arch sections and form a firm support for weight placed thereon and to restrain the effect of weight thereon from moving the opposed arch sections inwardly of each other.

BRIEF DESCRIPTION OF THE DRAWINGS

The invention will be more readily understood after reading the following description of the preferred embodiment of this invention given in conjunction with the drawings in which.

DETAILED DESCRIPTION OF THE INVENTION

Figure 1:
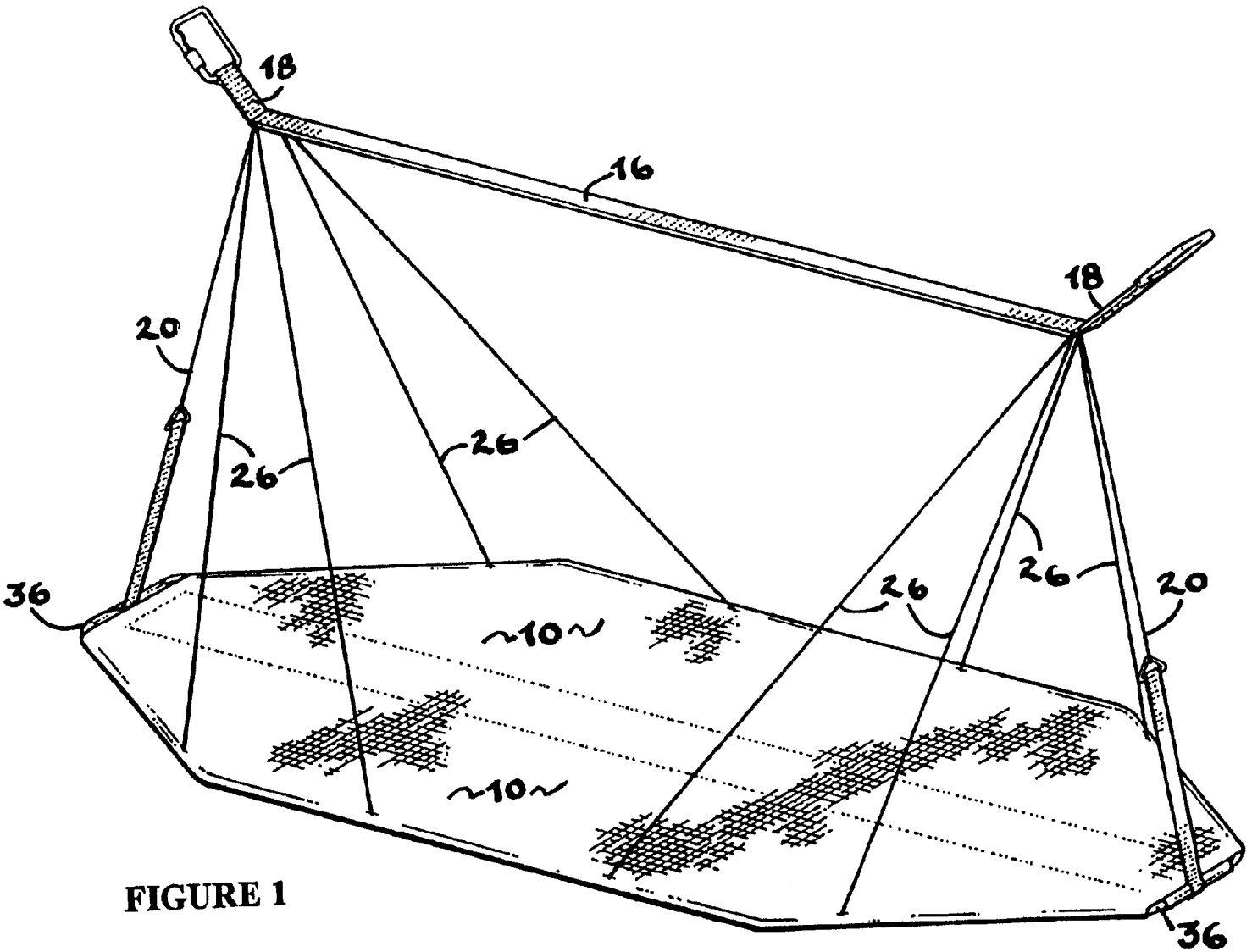
FIG. 1 is a perspective illustration showing the floor assembly of a tent according to this invention.
Figure 2:
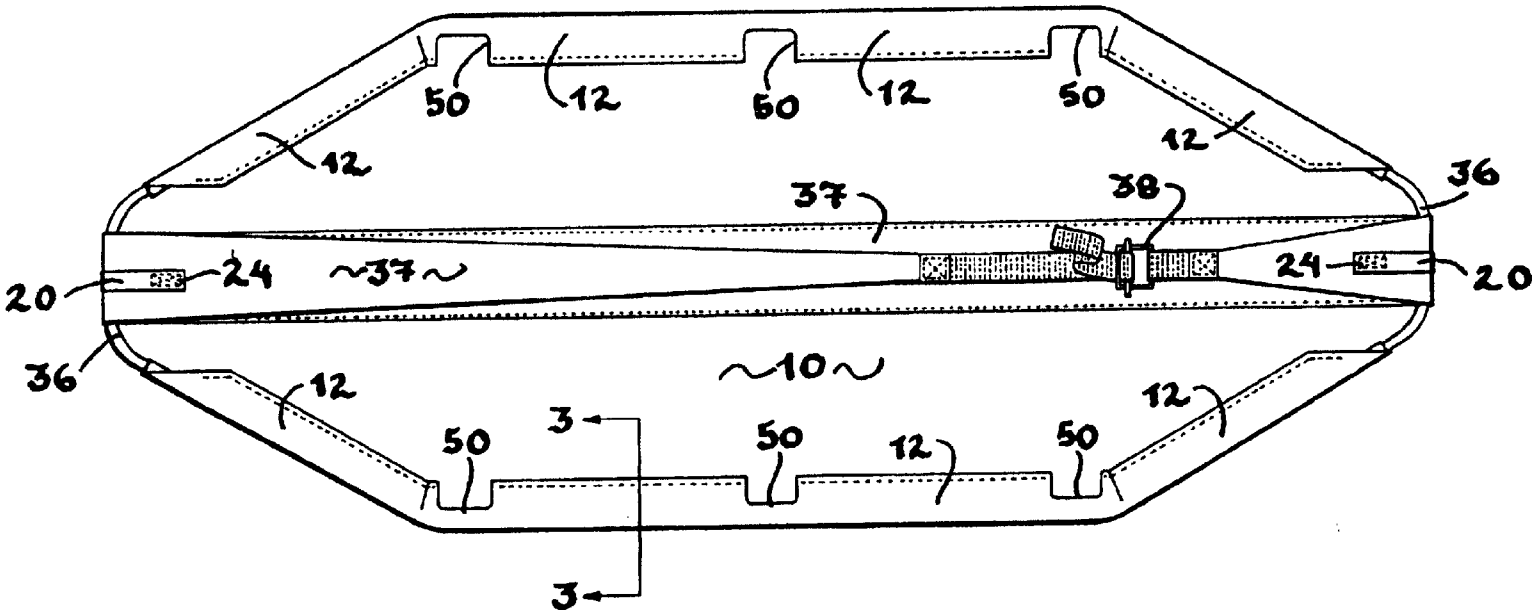
FIG. 2 is an illustration of the floor assembly from its underside.
Figure 3:
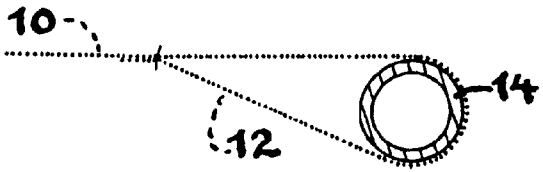
FIG. 3 is an illustration on line 3—3 of FIG. 2 showing the disposition of the frame in the hem of the floor.
Figure 4:
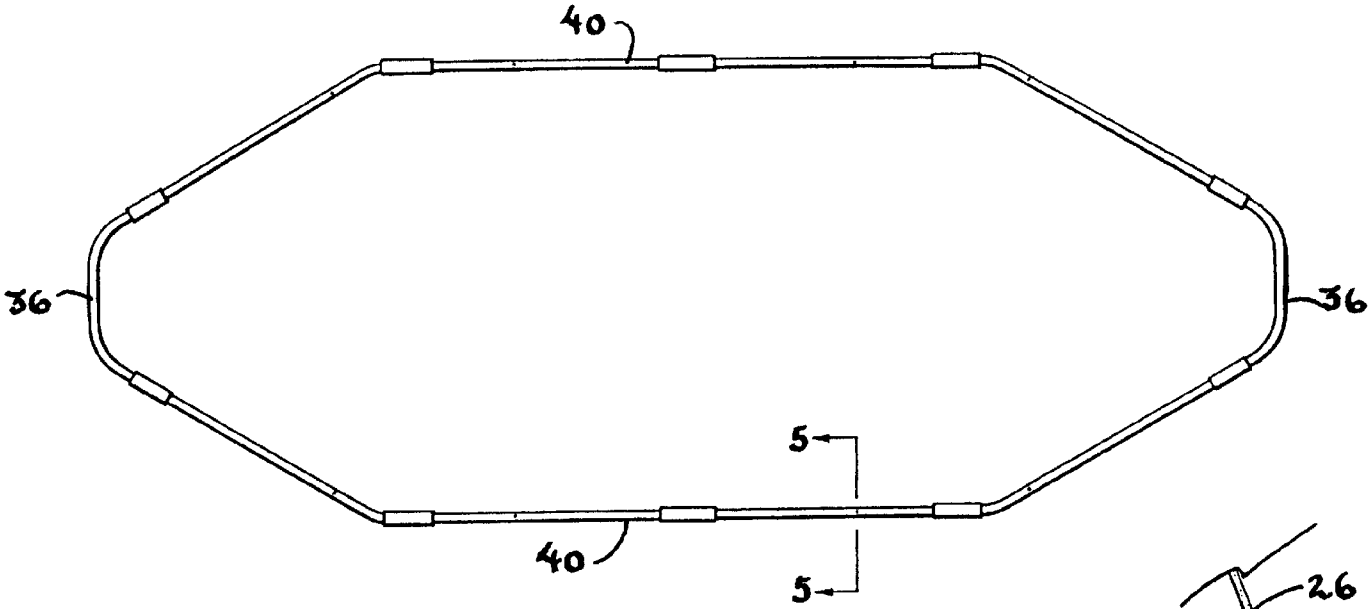
FIG. 4 is an illustration of the frame for the floor.
Figure 5:
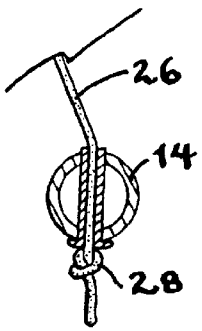
FIG. 5 is an illustration taken along 5—5 of FIG. 4 further showing how the levelling lines are connected to the frame.
Figure 6:
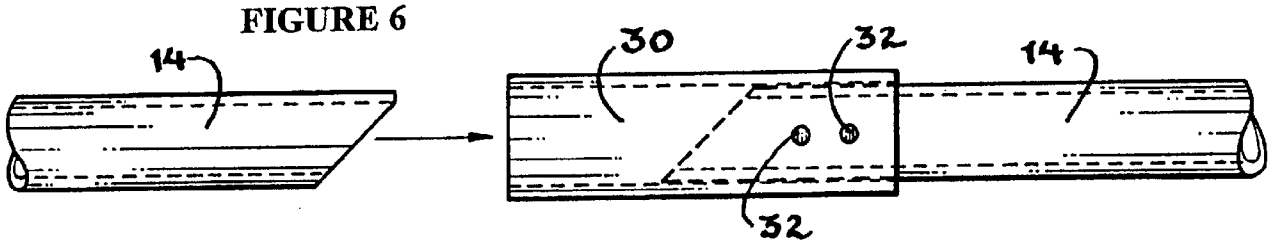
FIG. 6 is an illustration showing the manner of interconnection of the sections of the frame.
Figure 7:
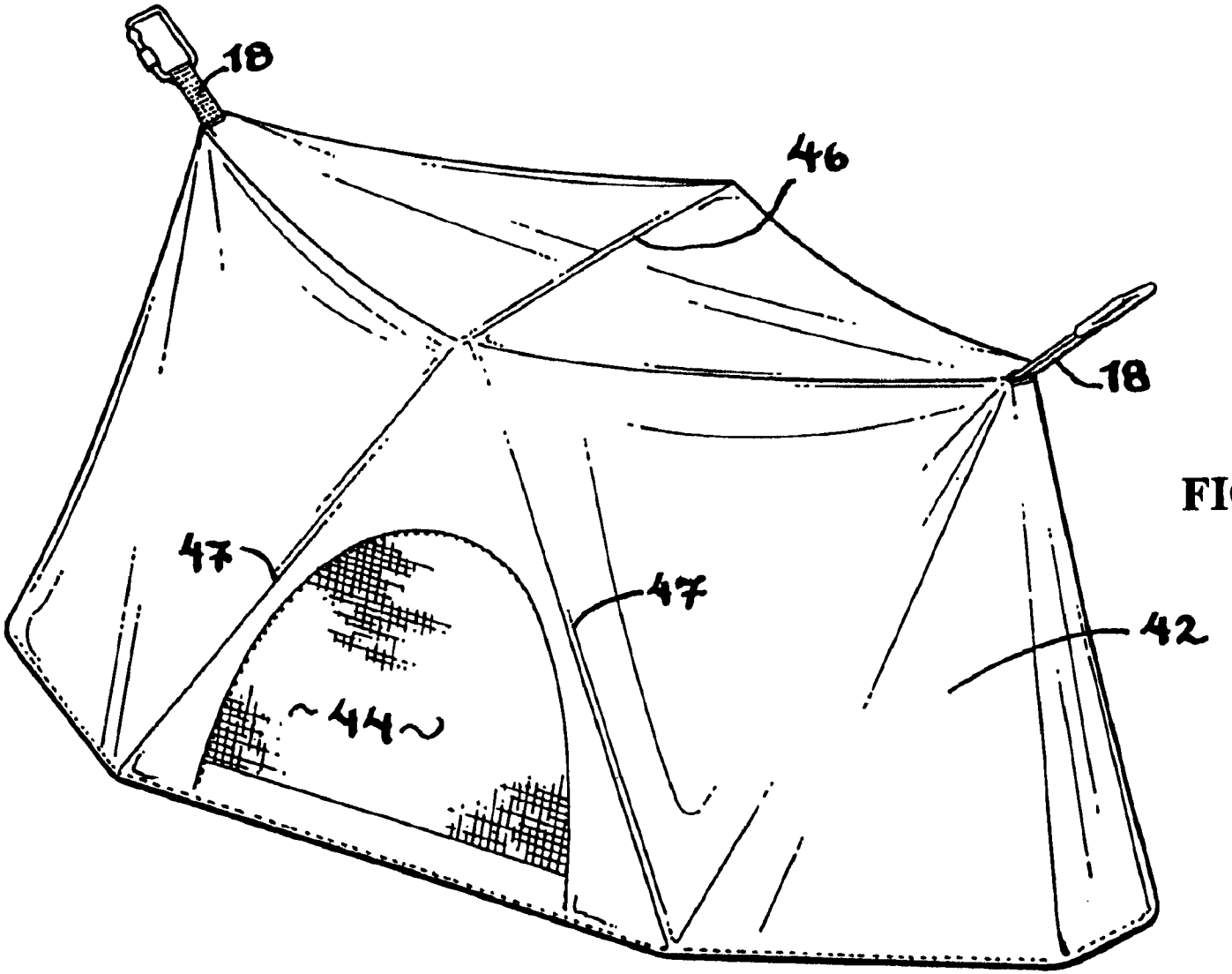
FIG. 7 is a view of the tent with the canopy in place.

Referring to the drawings and the embodiment of the invention therein illustrated, FIGS. 1 to 6 illustrate the rigging of the floor assembly for a tent. Therein illustrated is a floor assembly that has a fabric floor 10 with a circumferentially extending hem 12 that houses a lightweight tubular frame 14. The construction of the floor assembly and frame will be described in more detail later. Suffice it to say for now that when the base sections 36 of the frame are moved towards each other, the opposed flexible arch sections of the frame flex outwardly to tension and stress the floor fabric between the arch sections and maintain a level floor surface for load. The floor of the tent, in use, is supported in a sling.

The sling for the floor frame 12 has a ridge strap 16 that, in the embodiment illustrated, is somewhat shorter than the frame. It connects at each of its ends with a tent suspension cable 18 for the purpose of suspending the tent from a tree, a cliff or other rigid mounting device. Each end of the ridge strap 16 also connects with one end of a line cable 20. The other end of each sling cable connects to a belt on the underside of the floor as at 24.

Lines 26 are floor levelling lines which connect with the sling at one end and with the frame at spaced apart points as illustrated to maintain the floor level. Their connection to the frame 14 within the hem 12 of the floor 10 is illustrated at 28 in FIG. 6.

Thus, when the tent suspension lines 18 are mounted to appropriately spaced apart trees or the like rigid mountings, the floor is suspended above the ground.

The frame of the floor has opposed base sections 36 from which opposed flexible arch sections 40 extend. Arch sections 40 extend from an end of one base section 36 to the end of the other base section 36. A strong web belt 37 extends around the base sections 36 of the frame (FIG. 2) and has a buckle 38 that can be set to maintain any desired tightening of the belt around the base sections.

As the belt 37 is tightened around the base sections of the frame 14, the base sections are moved and maintained closer together by the tension in the belt and the opposed resilient arch sections of the frame, which extend between the base sections and flex outwardly of each other. As they do so, the tension the fabric support surface 10 between the opposed arch sections so that a flat firm support surface is formed for use as a tent floor.

In use, weight will be applied to this stretched floor surface and the resulting downward force will tend to pull the arch sections inwardly of themselves and move the base sections 36 of the frame outwardly. However, the base sections 36 of the frame cannot move outwardly because they are restrained from doing so by the tightened belt 37 and it follows that the arched sections cannot move inwardly. By locking the position of the base sections of the frame with the belt against outward movement, inward movement of the arch sections is locked and the floor cannot sag due to inward movement of the arch sections. The net effect of the weight on the floor is to increase tension in the belt 37 with no change of significance in the shape of the arched sections 40 of the frame. By tensioning and restraining the base sections of the frame, the frame has been rigidified against the effects of load on the floor and the stress is transferred to the web.

In use, the sections of the frame 14 are held together by the tensioning of the web 37. The sections engage each other at couplings 30. In the embodiment illustrated, each of the couplings 30 is secured to a single section of the frame by rivets 21.

It has been found that a frame having a length of about five feet and a width of about three feet made of anodized aluminum tubing 60611 T6 having an outer diameter of 0.75 inches and an inner diameter of 0.51 inches is satisfactory. The floor can be made from Dacron (trade mark) sailcloth having a weight of 170 grams per square meter. The weight of such a tent including canopy is about 8 pounds compared with about 30 pounds for an equivalent tent with a steel frame of the prior art.

The tent canopy generally indicated by the numeral 42 is draped over the suspended floor in use. It has an entry opening 44 and is supported by a roof pole as at 46 secured to the inner surface of the roof of the canopy and overlays the ridge strap 16. The roof pole gives the tent shape at its front as at 47 and similarly to the front at the tent's backside.

The roof pole used to give the tent is shape as at 46 and 47 is preferably made of plastics material. The canopy and pole design is not critical to the invention and detailed description is not included in this specification.

The tent can be disassembled for packing. The canopy is removed. The floor structure is lowered from its suspension and the tension on the floor tensioning belt is removed. The sections of the frame 14 are then loose in the hem of the fabric floor permitting disassembly from the couplings and can be accessed through access openings 50 for disengagement and removal. These openings are located at each frame joint. Once removed the various parts are packed in a kit bag for transport. Assembly is the reverse procedure.

An important aspect of the invention is the floor wherein the inward movement of the arch sections as load is applied to the floor is prevented by maintaining the base sections fixed with the tensioned belt whereby to keep the floor surface flat with increasing floor load. The load is partially absorbed by the increased belt tension.

Applicant has shown and claims a tent with such a floor but it is apparent that the floor structure can be used with similar advantages in other articles of manufacture that use a support surface of fabric with peripheral frame. Examples of such articles are stretchers, chairs, beds, etc. It is therefore intended to include articles of manufacture other than tents within the scope of the invention.

The embodiments of the invention in which an exclusive property or privilege is claimed are defined as follows:

1. An article of manufacture comprising;

a fabric support surface;

a peripheral frame for the fabric support surface, said frame having opposed base sections and opposed flexible arch sections extending between the base sections, the arch sections being responsive to movement of the base sections towards each other to flex the arch sections outwardly of each other and responsive to movement of the base sections away from each other to flex the arch sections inwardly of each other, said frame being secured to sad support surface along its flexible arch sections, and said fabric support surface having arch flexing means extending between and around the opposed base sections for controlling the position of the opposed base sections relative to each other to flex the arch sections outwardly of each other a distance to tension the fabric support surface between the arch sections to form a support for a weight placed thereon in use when the arch flexing means is tightened and for maintaining the base sections from separation to maintain the arch sections outwardly flexed of each other and to transmit the force of load on the fabric support surface transmitted to the arch members in use, from the arch sections, through the base sections to the arch flexing means.

2. An article of manufacture as claimed in claim 1 in which said arch flexing means comprises:

a belt that extends between and around the base sections and means for tightening said belt.

3. An article of manufacture as claimed in claim 1 in which:

said article of manufacture is a suspension tent and said fabric support surface is the floor of the tent.

4. An article of manufacture as claimed in claim 2 in which:

said article of manufacture is a suspension tent and said fabric support surface is the floor of the tent.

5. An article of manufacture as claimed in claim 3 having:

a sling extending around said opposed base sections of the frame and then upwardly to suspend the tent in use.

6. An article of manufacture as claimed in claim 4 having:

a sling extending around said opposed base sections of the frame and then upwardly to suspend the tent in sue.

7. An article of manufacture as claimed in claim 3 having:

a sling extending around said opposed base sections of the frame and then upwardly and inwardly to suspend the tent in use.

8. An article of manufacture as claimed in claim 4 having:

a sling ending around said opposed base sections of the frame and then upwardly and inwardly to suspend the tent in use.

* * * * *